US006796070B2

(12) United States Patent
Durossette

(10) Patent No.: US 6,796,070 B2
(45) Date of Patent: Sep. 28, 2004

(54) LOCKING MECHANISM FOR SEMI-AUTOMATIC HANDGUNS

(76) Inventor: Rick Durossette, 1676 Paseo Laguna Seco, Apt. 94, Livermore, CA (US) 94550

( * ) Notice: Subject to any disclaimer, the term of this patent is extended or adjusted under 35 U.S.C. 154(b) by 0 days.

(21) Appl. No.: 10/359,510

(22) Filed: Feb. 5, 2003

(65) Prior Publication Data

US 2003/0145504 A1 Aug. 7, 2003

Related U.S. Application Data

(60) Provisional application No. 60/354,620, filed on Feb. 7, 2002.

(51) Int. Cl.[7] ..... F41A 17/00
(52) U.S. Cl. ..... 42/70.04; 42/70.08
(58) Field of Search ..... 42/70.04, 70.08

(56) References Cited

U.S. PATENT DOCUMENTS 4,306,487 A * 12/1981 Beretta ..... 89/148
5,225,612 A * 7/1993 Bernkrant ..... 42/70.02
5,570,527 A * 11/1996 Felicci ..... 42/70.08
5,603,179 A * 2/1997 Adams ..... 42/70.08
5,651,206 A * 7/1997 Matarazzo ..... 42/70.08
5,743,039 A * 4/1998 Garrett ..... 42/70.11
6,205,694 B1 * 3/2001 Davis, Sr. ..... 42/69.03
6,374,526 B1 * 4/2002 Mochak ..... 42/70.08
6,405,471 B1 * 6/2002 Mauch ..... 42/70.11
6,510,639 B2 * 1/2003 McMoore ..... 42/70.06
6,530,306 B1 * 3/2003 LaFleur ..... 89/188
2001/0016999 A1 * 8/2001 Williams ..... 42/70.08

* cited by examiner

*Primary Examiner*—Michael Carone
*Assistant Examiner*—M. Thomson
(74) *Attorney, Agent, or Firm*—Bruce H. Johnsonbaugh

(57) ABSTRACT

A locking mechanism is provided for a semi-automatic handgun. The locking mechanism is readily retrofitted onto the back of the handle frame of a used handgun. The locking mechanism includes a pair of guide rails fixedly attached to the back of the handle frame and a movable locking bar slidably carried between the guide rails. The locking bar is movable between two positions. The first is an unlocked position in which the handgun may be fired. The movable locking bar can be readily moved upwardly to a second locked position in which it interferes with the forward motion of the drawbar. Since the drawbar cannot move forward, the handgun cannot be fired, the slide cannot be actuated and the user is unable to chamber a round. The locking bar is unlocked by a key actuated locking cylinder carried in the bottom of the movable locking bar. The user can quickly lock the gun by simply pushing upwardly on the movable locking bar.

6 Claims, 15 Drawing Sheets

LOCKING MECHANISM FOR SEMI-AUTOMATIC HANDGUNS

CROSS-REFERENCE TO RELATED APPLICATION

This application claims the benefit of and priority from U.S. provisional application Serial No. 60/354,620 filed Feb. 7, 2002.

BACKGROUND AND BRIEF SUMMARY OF THE INVENTION

The present invention relates generally to the field of handgun safety. More particularly, the present invention provides a locking mechanism for semi-automatic handguns, such as those used by many law enforcement agencies.

The typical prior art locking devices require the use of either a safe in which to store the gun or an external cover for the barrel or trigger housing. In contrast, the present invention provides a locking mechanism located within the perimeter of most semi-automatic handguns with the exception of a small protrusion from the base of the handle. The present invention allows the gun to be holstered in either its locked or unlocked position.

A significant aspect of the invention is that law enforcement personnel can lock the gun in its holstered or unholstered position without a key, simply by pushing upwardly against the small protrusion extending below the handle. This aspect of the invention is extremely useful in those situations where an unlocked and loaded gun presents a potential hazard to the person carrying it, such as in some crowd control situations, etc. A police officer dealing with a disturbance in a crowded place (such as a bar, a ballpark, an unruly demonstration, etc.), where there may be a significant risk his gun may be pulled out of his holster and used against him (or others), can simply depress the small protrusion at the base of the handle and the gun is locked. Any person forcibly taking the locked gun from the police officer cannot pull the trigger, cannot move the slide to chamber a round and cannot operate the hammer. Any attempt by such person to remove the lock from the gun disables the main spring actuating the hammer, and the gun cannot be made to fire. The police officer, after locking his gun, may unlock it by inserting a key into the base of the handle and turning it, and the gun is operable.

A significant novel feature of the invention is that, in its locked position, it positively interrupts the forward motion of the drawbar. When the drawbar cannot move forward to release the sear, which in turn releases the hammer, there is simply no way to cause the gun to fire. The trigger cannot be pulled, the slide cannot be moved to chamber a round and the hammer cannot be actuated.

Another significant feature of the invention is that it can be retrofitted onto used semi-automatic handguns. Furthermore, new semi-automatic handguns do not have to be redesigned to any significant extent to accommodate the invention.

A primary object of the invention is to provide a locking mechanism for semi-automatic handguns.

A further object of the invention is to provide a semi-automatic handgun locking mechanism which may be locked very quickly without the use of a key.

Another object of the invention is to provide a locking mechanism for semi-automatic handguns which, except for a small protrusion from the base of the handle, is positioned within the normal, exterior surface of the handgun.

A further object of the invention is to provide a locking mechanism which may be retrofitted onto used semi-automatic handguns.

Another object is to provide a locking mechanism for semi-automatic handguns which incorporates a lock with multiple tumblers, enabling the use of a large number of unique key codes.

A further object is to provide a locking mechanism for semi-automatic handguns wherein attempts made by those other than skilled gunsmiths or locksmiths to remove the locking mechanism will disable the handgun, rendering it incapable of firing.

Other advantages of the invention will become apparent from the drawings and the following description of the drawings.

DETAILED DESCRIPTION OF THE DRAWINGS

Figure 1:
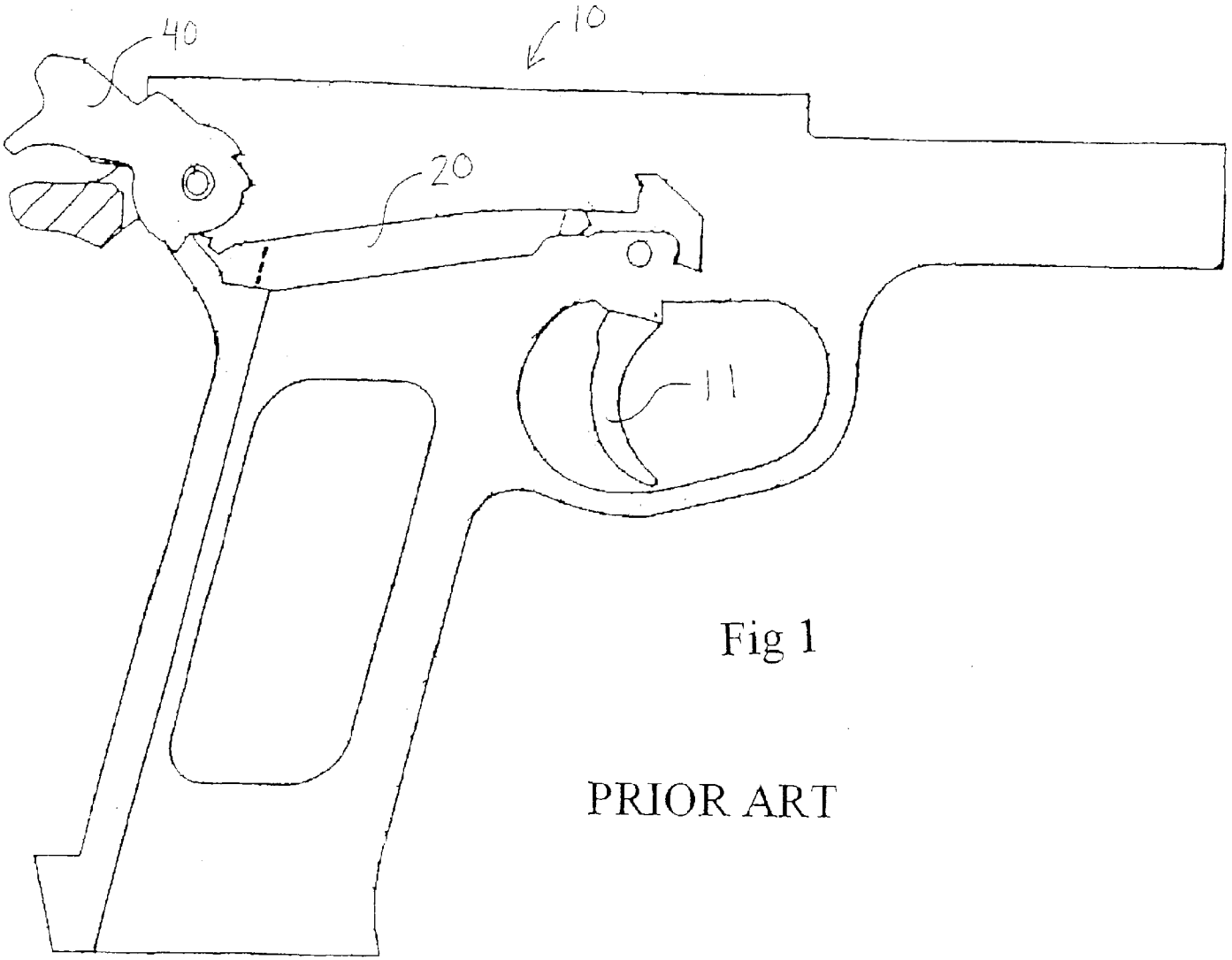
Fig 1 PRIOR ART
FIG. 1 is a schematic illustration of a portion of a prior art semi-automatic handgun wherein the drawbar is illustrated in its resting or non-firing position.
Figure 2:
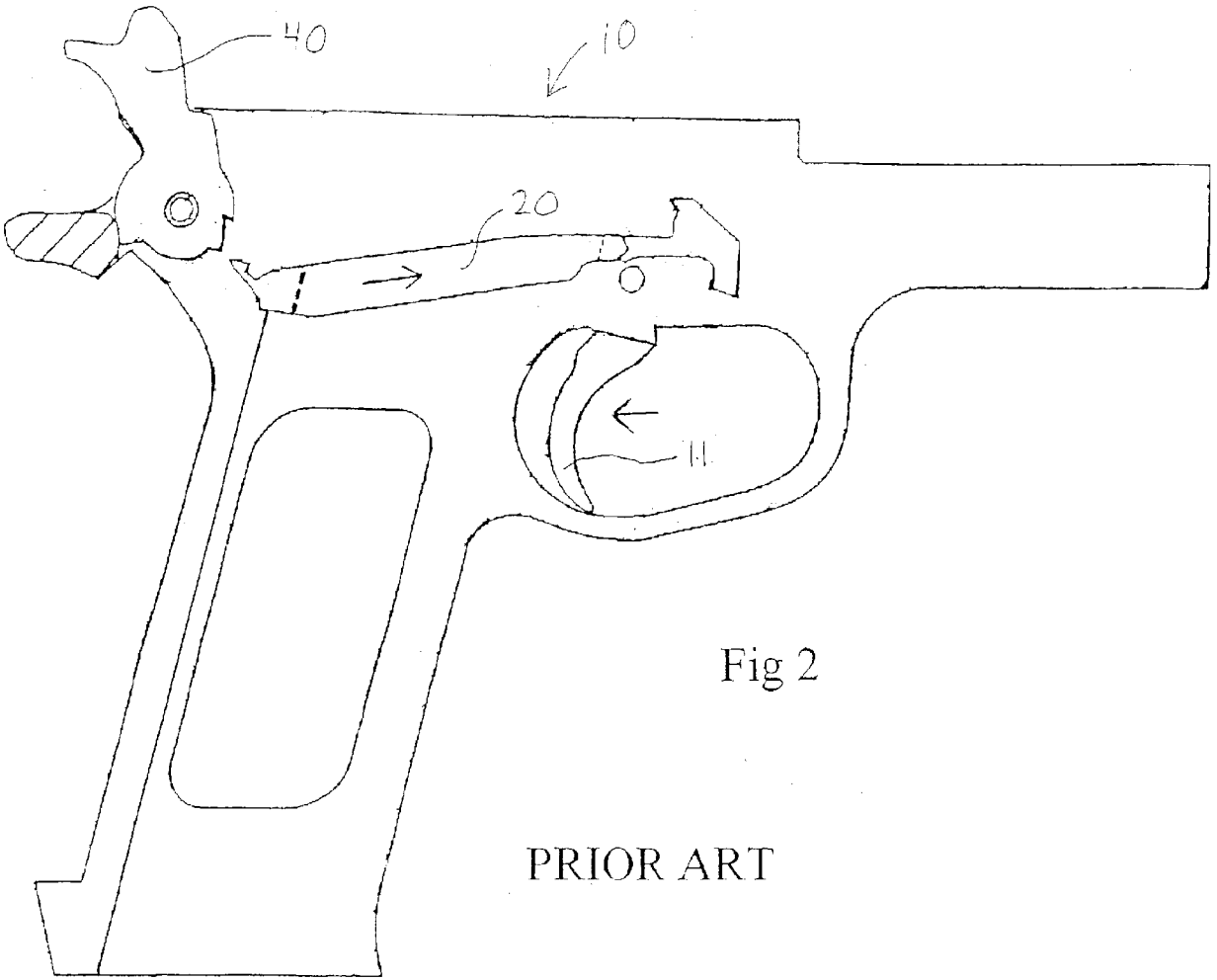
Fig 2 PRIOR ART
FIG. 2 is a schematic illustration of portions of a semi-automatic handgun shown in FIG. 1 wherein the trigger has been depressed and the drawbar has been pulled forward to its firing position wherein a round is fired.

FIGS. 1 and 2 are schematic illustrations of portions of a prior art semi-automatic handgun 10. Most of the components of the gun, such as the slide, the sear, hammer, mainspring and handle grips, are deleted in the interest of clarity in illustrating the parts of the firing mechanism critical to the present invention. When the trigger 11 is pulled, drawbar 20 moves forward and releases the sear (not shown for clarity) which in turn releases hammer 40 to fire the handgun.

Figure 3:
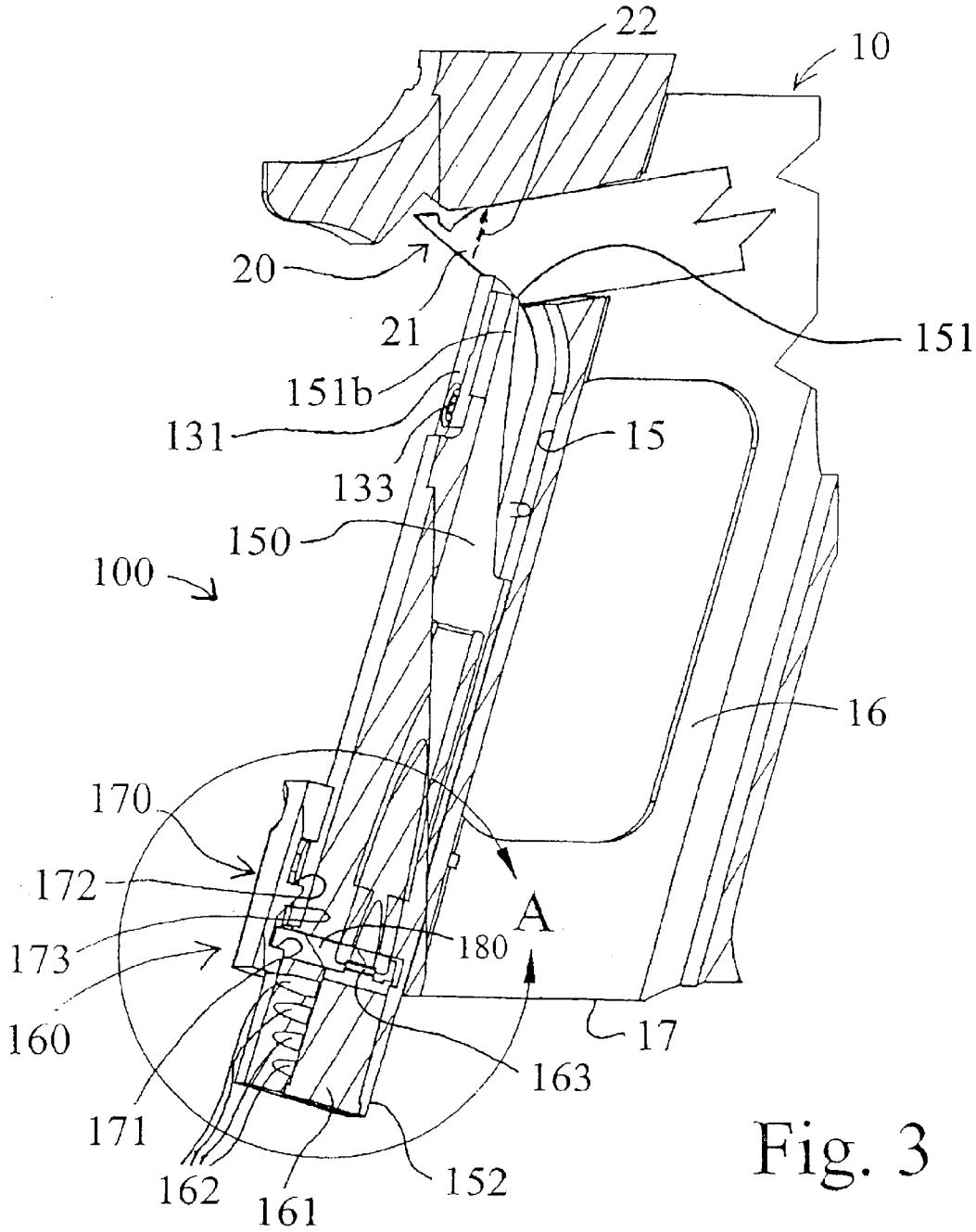
FIG. 3 is a schematic illustration of a portion of the rear of a handgun illustrated in FIG. 1 wherein the locking mechanism of the present invention has been added to the handle frame and is positioned in the unlocked or firing position.
Figure 4:
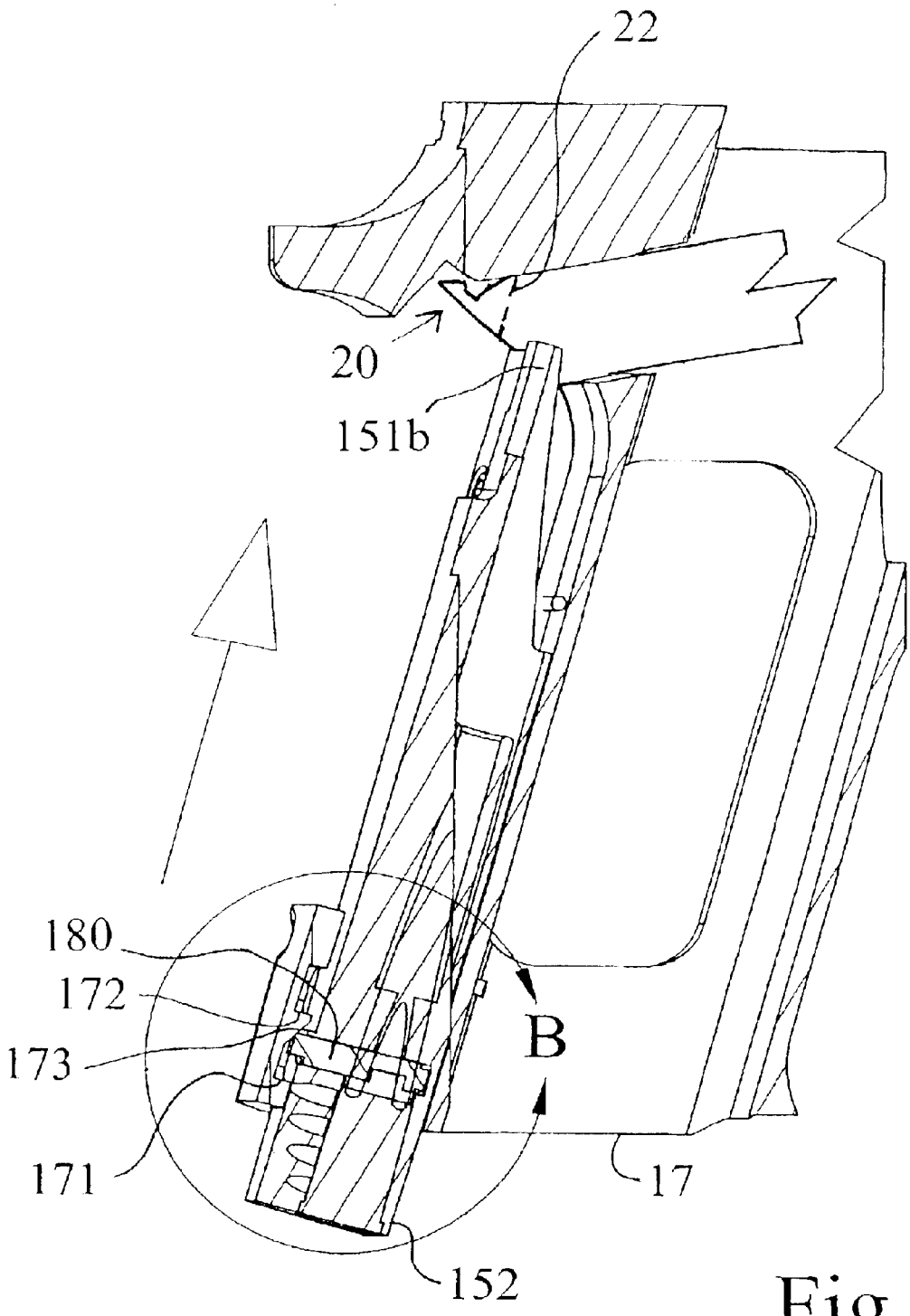
FIG. 4 is a schematic illustration of the locking mechanism of the present invention as illustrated in FIG. 3 wherein the locking mechanism is in the process of moving to the locked position.
Figure 5:
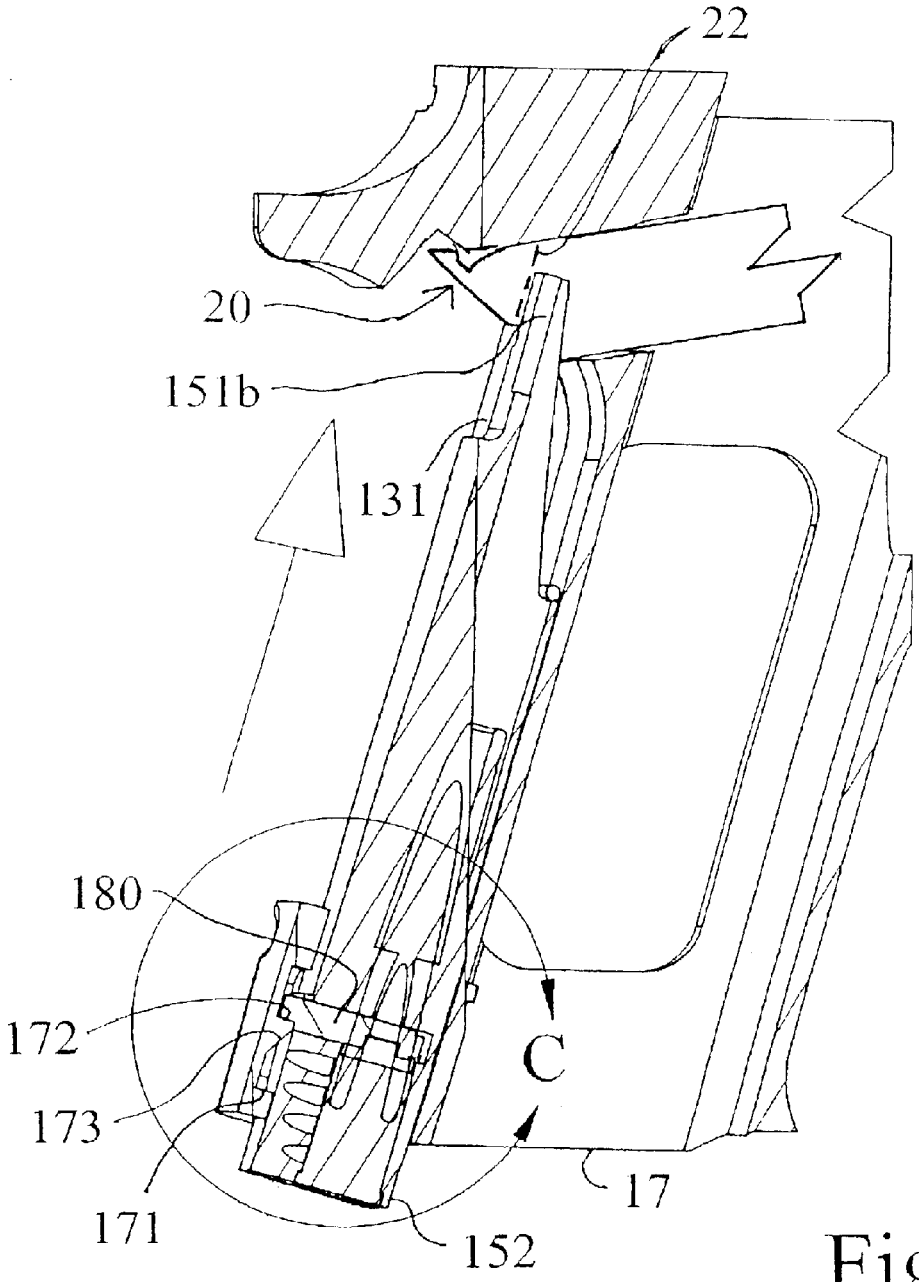
FIG. 5 is a schematic illustration of the portion of the gun illustrated in FIGS. 3 and 4 wherein the locking mechanism of the present invention has been moved to its locked position wherein the gun cannot be fired.

FIGS. 3, 4 and 5 are schematic illustrations showing how the locking mechanism of the present invention shown generally as 100 is retrofitted onto handgun 10 of FIGS. 1 and 2 Locking mechanism 100 is mounted to the back side 15 of handle frame 16 of handgun 10. In FIGS. 3–5, the rearmost portion is shown of drawbar 20 with drawbar 20 shown in its resting or non-firing position. Drawbar 20 has a generally rectangular loop configuration as shown best in FIG. 9. The rear cross member 21 extends transversely across the back of handgun 10 and has a split surface 22 illustrated in dashed lines in FIGS. 3–5. The split surface 22 of the rear cross member 21 moves forward towards the rear surface 15 of frame 16 as the trigger is pulled.

The locking bar is shown generally as 150 and includes an upper tip 151 and a hollow lower end 152 described in greater detail below. In the unlocked, first position shown in FIG. 3, the upper tip 151 of locking bar 150 is below drawbar 20. Drawbar 20 is therefore free to move forward to fire the gun. As shown in FIG. 4, as the user pushes upwardly on the lower end 152 of locking bar 150, the upper tip 151 of locking bar 150 is moving upwardly and beginning to interfere with the forward motion of drawbar 20. As shown in FIG. 5, upper tip 151 of locking bar 150 has moved to its second, locking position wherein it blocks the forward motion of drawbar 20 when the user of the handgun attempts to pull the trigger. In the locked position illustrated in FIG. 5, the handgun 10 simply cannot be fired.

As locking bar 150 moves between its first unlocked position illustrated in FIG. 3 to its second locked position shown in FIG. 5, the locking means shown generally as 160 interacts with the lower portion 152 of locking bar 150. A generally horizontally disposed locking pin 180 interacts with a stationary plate or bridge 170. Bridge 170 has a first abutment 171 against which locking pin 180 seats in the unlocked position shown in FIG. 3. Bridge 170 has a second abutment 172 against which locking pin 180 seats in the locked position shown in FIG. 5. Between the first and second abutments 171 and 172, bridge 170 has an inclined ramp 173 against which locking pin 180 moves as locking bar 150 is in the process of moving to its locked position, as shown in FIG. 4. Locking pin 180 is spring loaded by a spring (not shown) which biases it into its extended position shown in FIGS. 3 and 5.

Locking means 160 includes a key actuated cylinder lock 161 having a keyway and a plurality of tumblers 162. In the embodiment illustrated in FIGS. 3–8, four separate tumblers 162 are illustrated. The use of multiple tumblers facilitates the use of a large number of unique key codes. In order to unlock the locking means 160, the user inserts a key (not shown) into a keyway located at the lower end of cylindrical lock 161 and rotates the key. Rotation of the key causes locking pin 180 to move against its spring bias off of locking abutment 172 and locking bar 150 moves downwardly from its locked position shown in FIG. 5 by the force generated by the main hammer spring (not shown in FIGS. 3–8 for clarity).

Figure 6:
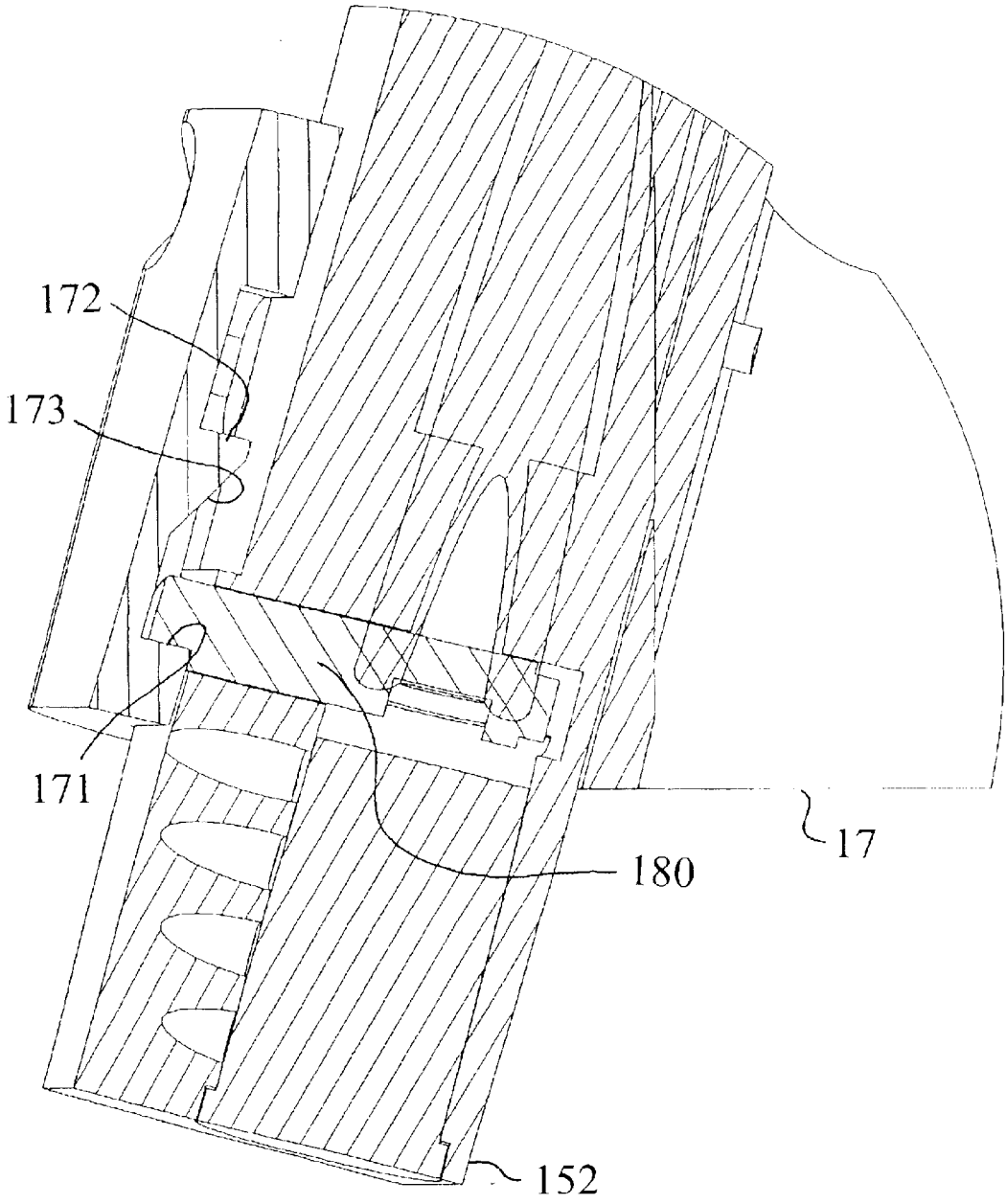
FIG. 6 is an enlargement of the encircled area "A" of FIG. 3.
Figure 7:
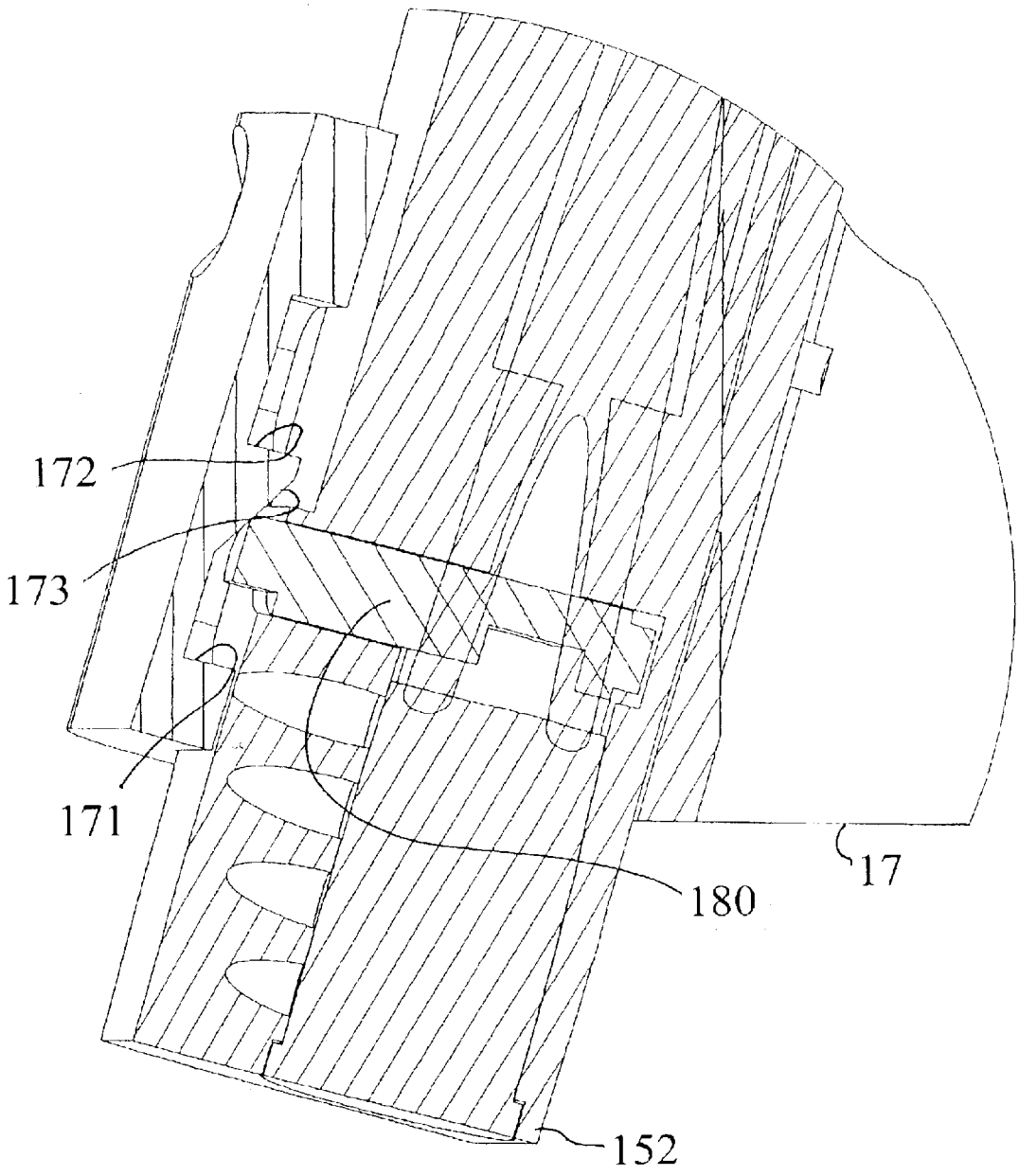
FIG. 7 is an enlargement of the encircled area "B" of FIG. 4.
Figure 8:
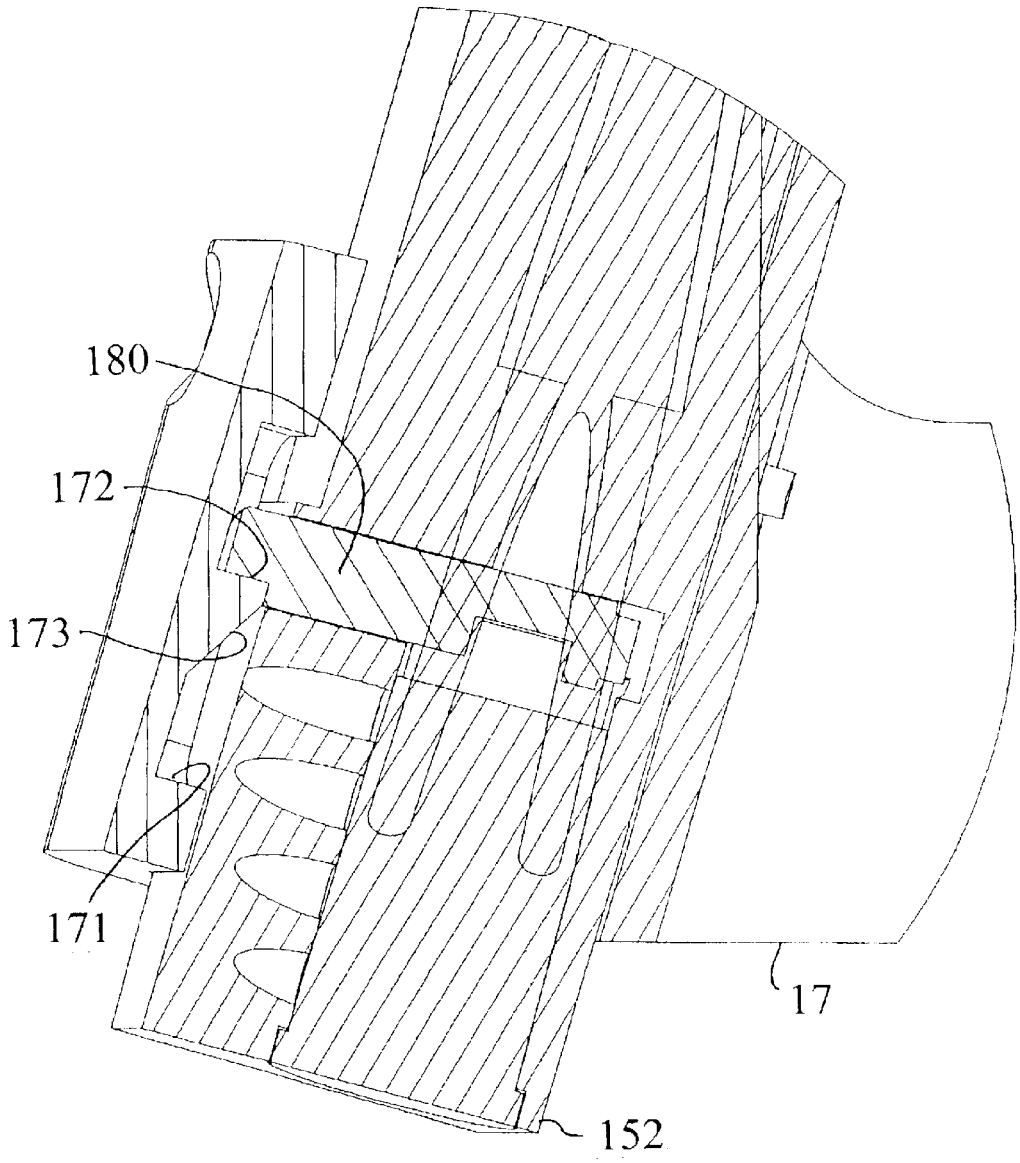
FIG. 8 is an enlargement of the encircled area "C" of FIG. 5.

FIGS. 6–8 are exploded views of the circular regions A, B and C identified in FIGS. 3–5, respectively. FIGS. 6–8 show in greater detail how the locking pin 180 moves between abutments 171 and 172 as the locking bar 150 moves between its unlocked and locked positions.

Figure 9:
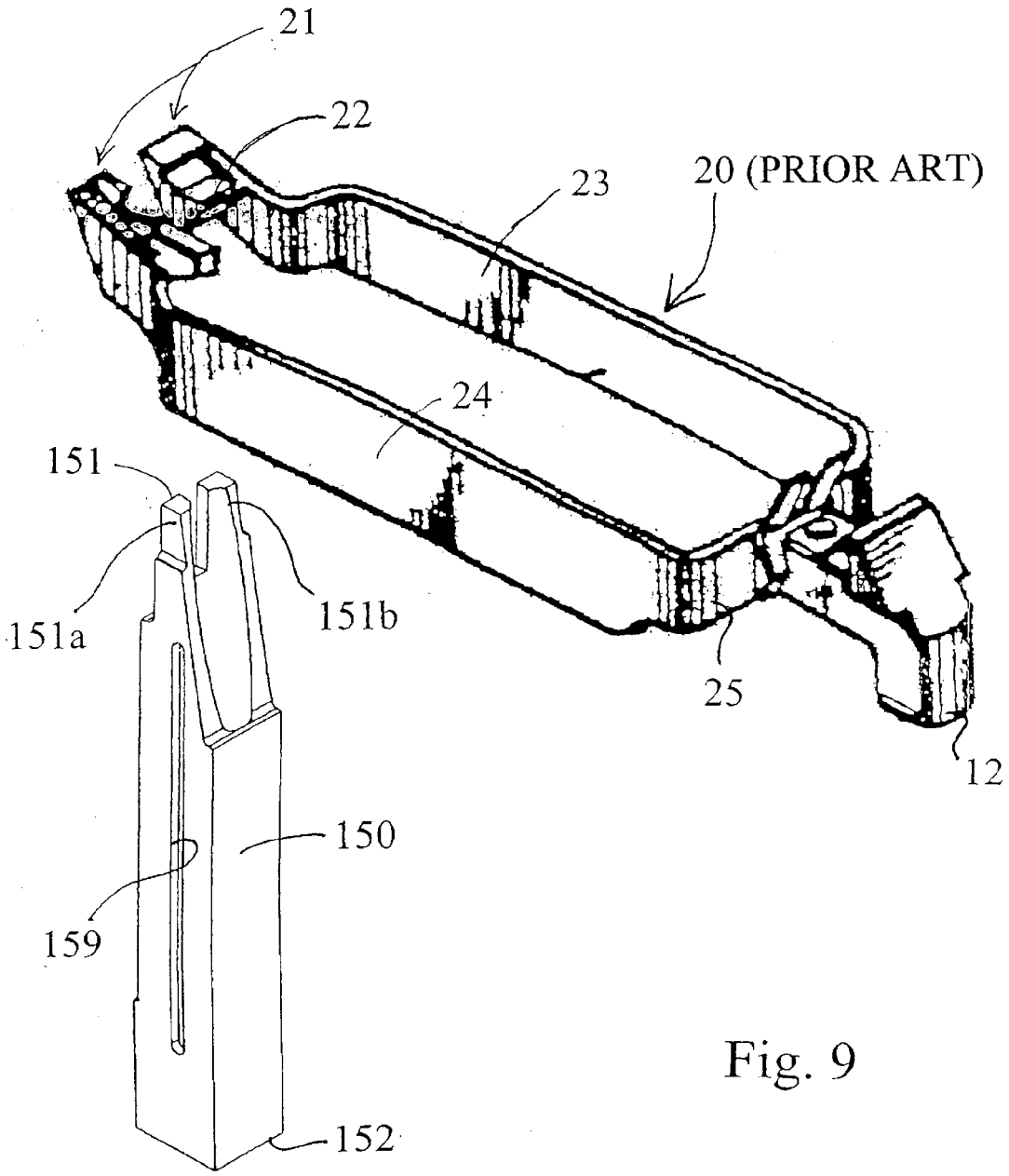
FIG. 9 is a perspective view showing a prior art drawbar along with the locking bar according to the present invention.

FIG. 9 is a perspective view of a drawbar used in conjunction with Smith and Wesson brand semi-automatic pistols. The drawbar has a generally rectangular loop configuration to allow bullets stored in the magazine to move upwardly through the loop formed by drawbar 20 into the firing chamber. The rear cross member 21 is a relatively complex surface to allow the drawbar to interact with the sear and other parts of the firing mechanism. The split surface 22 of rear cross member 21 is the surface which locking bar 150 contacts. The upper tip 151 of movable locking bar 150 has two fingers 151*a* and 151*b* which are illustrated in FIG. 9 in position below drawbar 20. As the locking mechanism moves to its locked position, the upper tip 151 of locking bar 150 moves upwardly and fingers 151*a* and 151*b* contact split surface 22 of rear cross member 21 of drawbar 20, preventing drawbar 20 from moving forward to fire the weapon. Drawbar 20 has side rails 23 and 24 and a forward crossbar 25 connected to member 12 which interacts directly with the trigger mechanism to cause the forward and rearward motion of drawbar 20.

Figure 10:
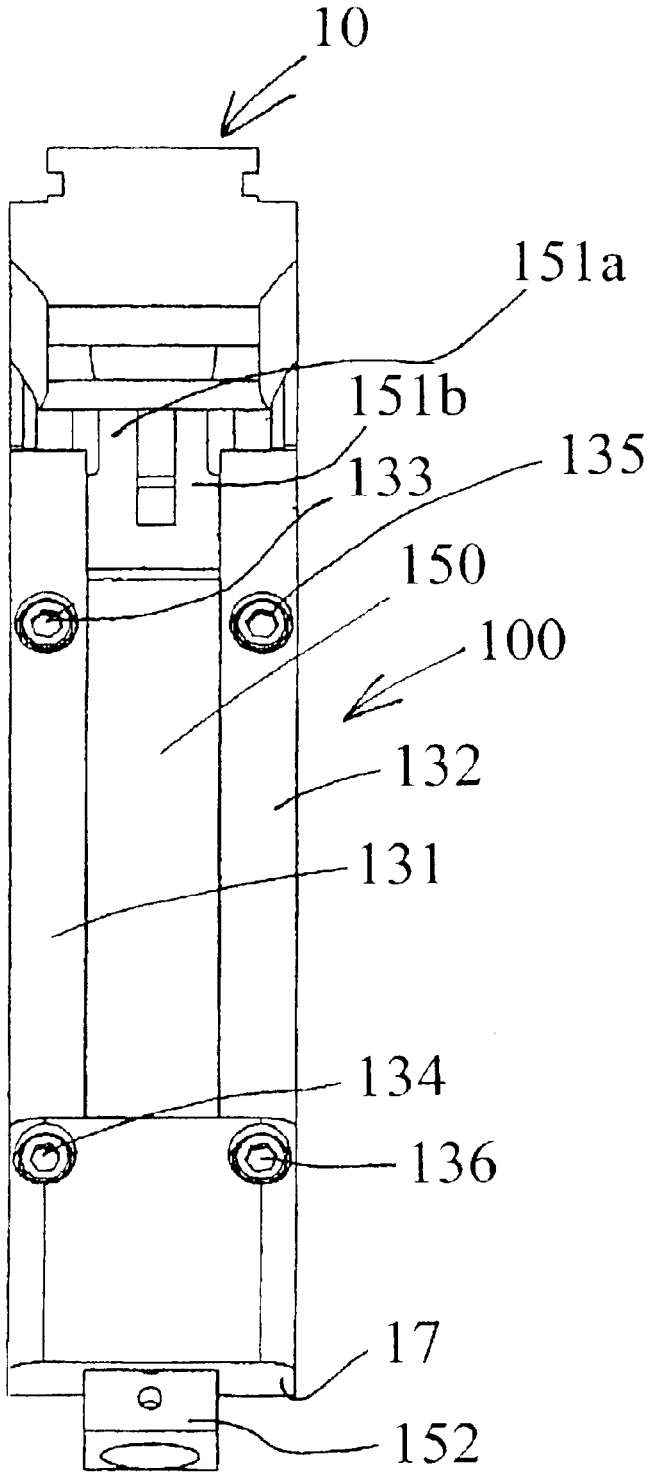
FIG. 10 is a rear elevational view of the handgun frame shown in FIG. 3 showing the locking mechanism of the present invention as attached to the handgun frame.

FIG. 10 is a rear elevational view of the locking mechanism shown generally as 100 attached to the frame of handgun 10. First and second guide rails 131 and 132 are attached to the left and right-hand side of the rear surface 15 of handle frame 16, respectively Guide rails 131 and 132 are fixedly mounted to frame 16 by threaded screws 133, 134 and 135, 136, respectively. Locking bar 150 is slidably carried between first and second guide rails 131, 132. Movable locking bar 150 in the embodiment shown has a pair of elongated channels formed on either side which cooperate with elongated ribs formed on each of guide rails 131 and 132. The lower end 152 of locking bar 150 protrudes below the lower surface 17 of handle frame 16. As illustrated in FIG. 10, the locking mechanism 100 is in its locked position and the protrusion 152 formed by the lower tip of locking bar 150 extends less than 0.25 inches below the lower surface 17 of handle frame 16.

Figure 11:
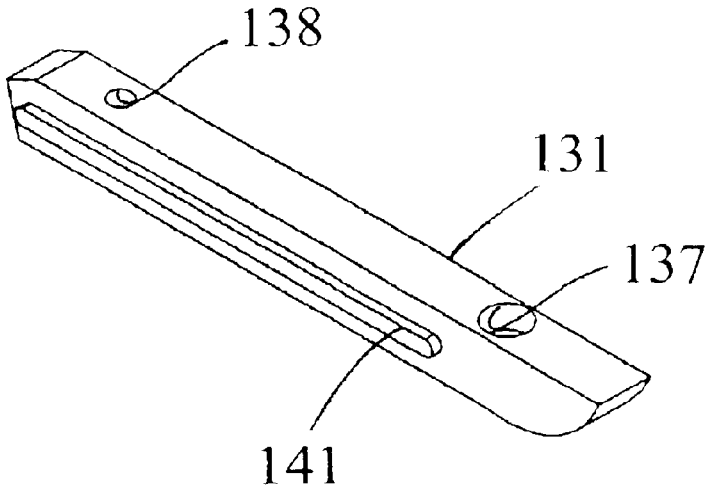
FIG. 11 is a perspective view of the left-hand guide rail according to the present invention.

FIG. 11 is a perspective view of left-hand guide rail 131 showing elongated rib 141 which slidably engages locking bar 150. Passageway 137 is formed near the upper tip of guide rail 131 and receives threaded screw 133. A smaller passageway 138 is formed near the lower end of guide rail 131 and is threaded to engage screw 134. Guide rail 132 is symmetrical with guide rail 131 and has a elongated rib adapted to engage locking bar 150.

Figure 12:
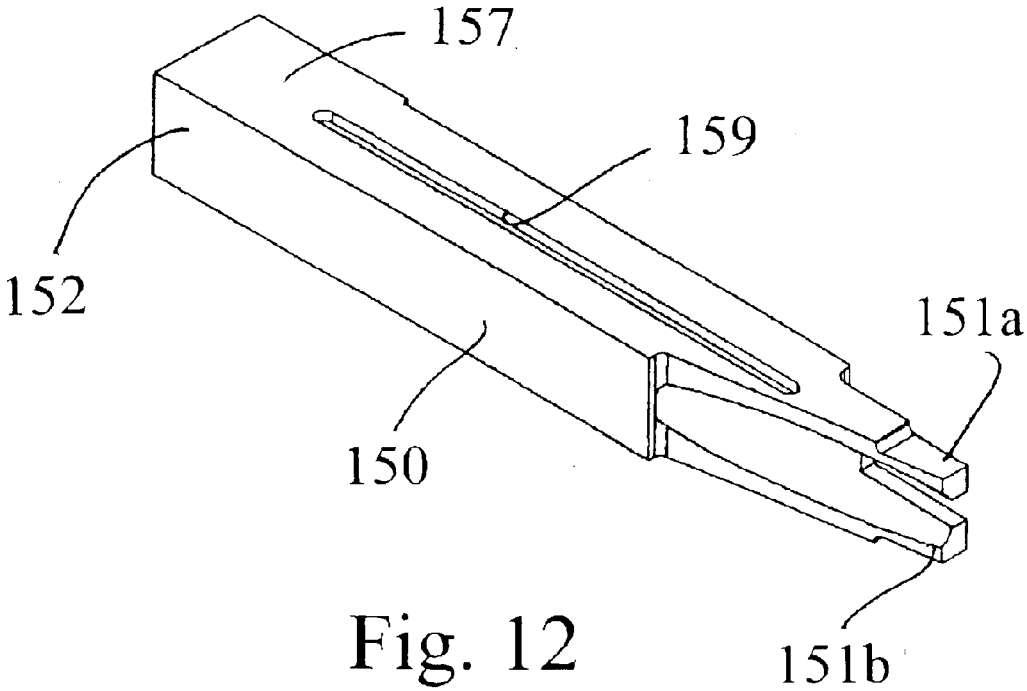
FIG. 12 is a perspective view of the locking bar according to the present invention.
Figure 13:
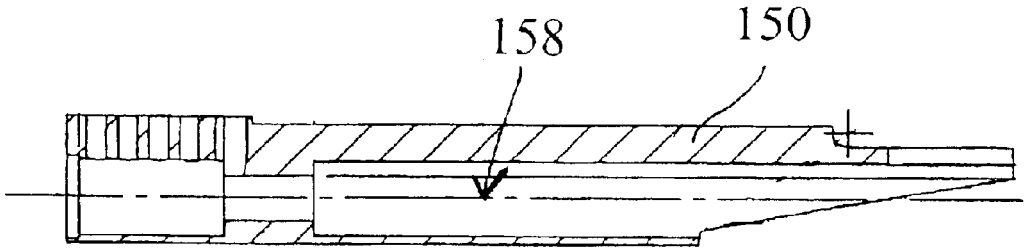
FIG. 13 is a sectional view of the locking bar shown in FIG. 12.
Figure 14:
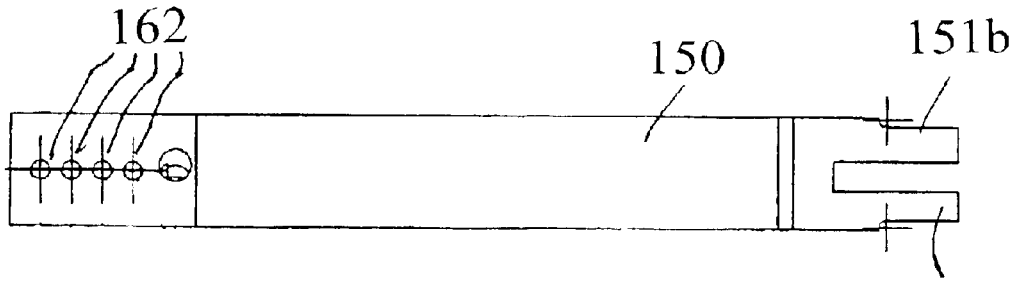
FIG. 14 is a bottom elevational view of the locking bar of FIGS. 12 and 13.
Figure 15:
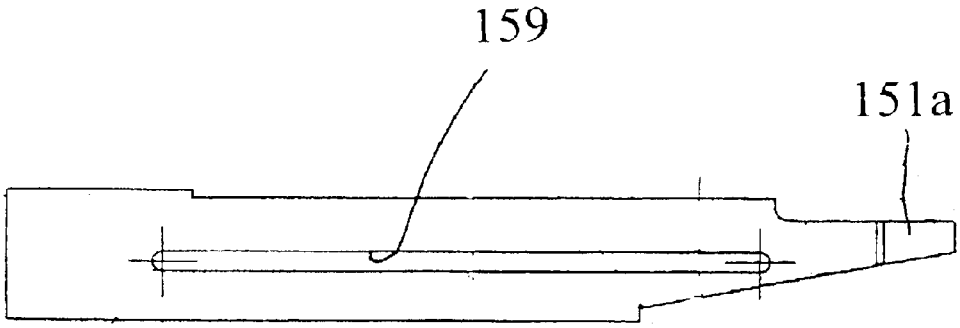
FIG. 15 is a side elevational view of the locking bar shown in FIGS. 12–14.
Figure 16:
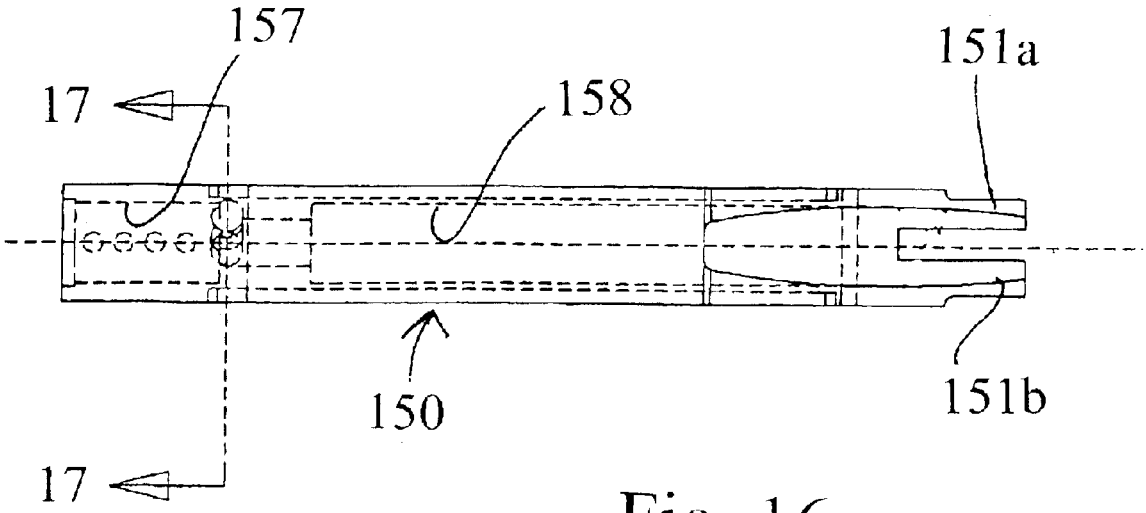
FIG. 16 is a top plan view of the locking bar of FIGS. 12–15.
Figure 17:
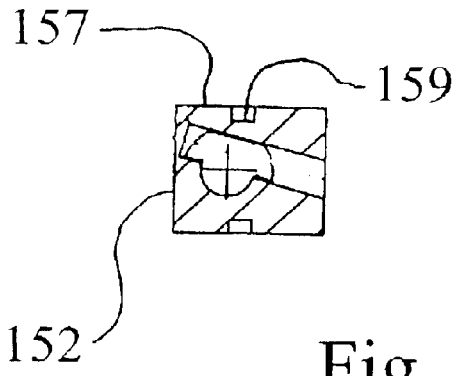
FIG. 17 is a section on the line 17—17 of FIG. 16.

FIGS. 12–17 illustrate locking bar 150. FIG. 12 is a perspective view of locking bar 150 showing its forked or split upper end 151*a* and 151*b* and its hollow lower end 152. An elongated recess 159 is formed in side wall 157 and is adapted to slidably engage right-hand guide rail 132. A similar elongated recess is formed on the opposite side of locking bar 150 to engage the opposite guide rail. FIG. 13 shows the hollowed chamber 158 in which the main hammer spring is carried. In the interest of clarity, the main hammer spring is not illustrated in the drawings. FIG. 14 is a bottom view illustrating the position of the tumblers 162. FIG. 15 is a side elevational view illustrating elongated recess 159 and tip 151 a. FIG. 16 is a top view illustrating in phantom the position of chamber 158 which carries the hammer spring and chamber 157 which carries the locked cylinder. FIG. 17 is a section on the line 17—17 of FIG. 16 and shows the angular orientation of the surfaces which guide the movable locking pin 165.

Figure 20:
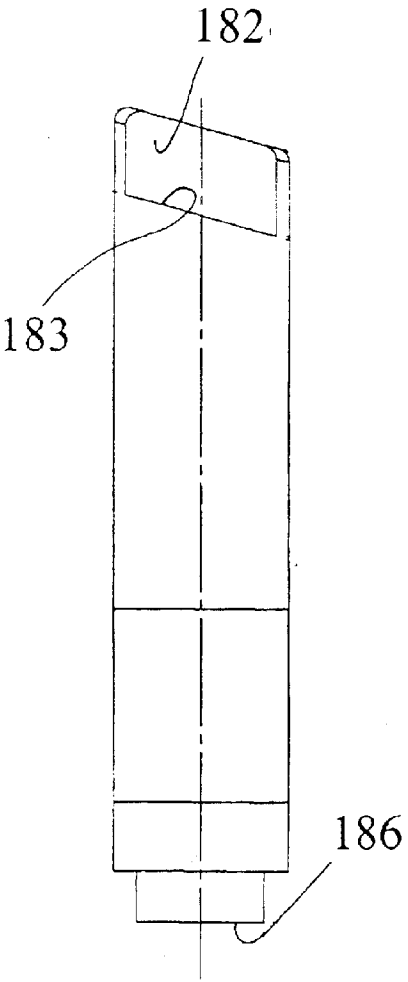
FIG. 20 is a side elevational view of the locking pin of FIGS. 18 and 19.
Figure 19:
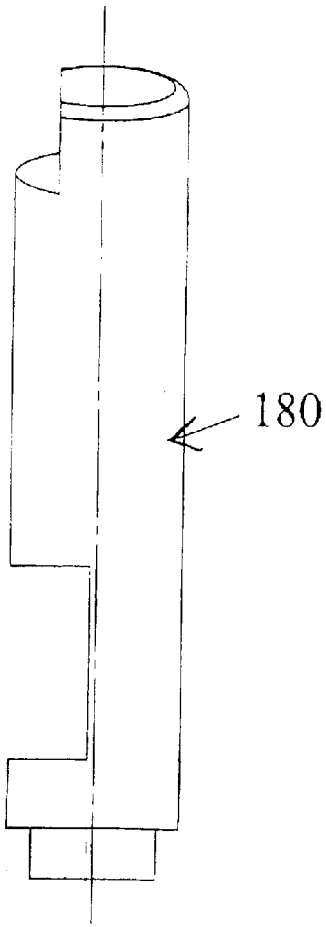
FIG. 19 is a front elevational view of the locking pin of FIG. 18.
Figure 18:
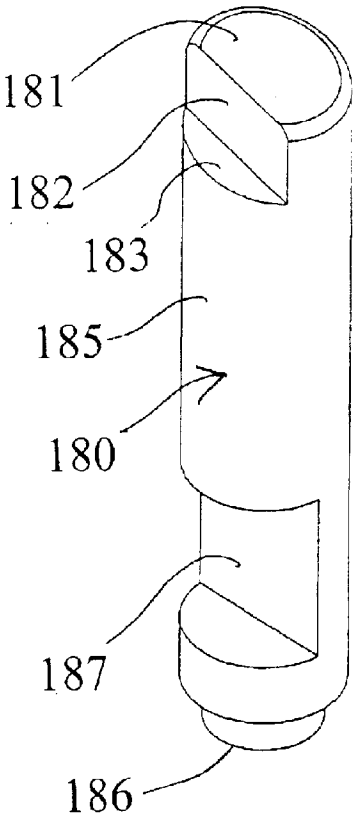
FIG. 18 is a perspective view of the locking pin component of the present invention.

FIGS. 18, 19 and 20 illustrate movable locking pin 180. Pin 180 has a first end 181 with a flattened and recessed surface 182 and shoulder 183 which engage abutments 171 and 172 on the fixed bridge 170. Locking pin 180 has a generally cylindrical shaped body 185. The second end 186 has a reduced diameter and is adapted to receive a spring (not shown for clarity) which tends to bias locking pin against abutments 171 and 172. Shoulder 183 is perpendicular to surface 182 and shoulder 183 together with surface 182 to seat against either abutment 171 or 172. A channel 187 is formed near the second end 186 of locking pin 180. The purpose of channel 187 is to interact with the eccentric tip 163 of locking cylinder 161, thereby causing locking pin 180 to move in response to rotation of a key rotating cylinder lock 161. FIG. 19 is a front elevational view of locking pin 180. FIG. 20 is a side elevational view showing the inclined slope of shoulder 183.

Figure 21:
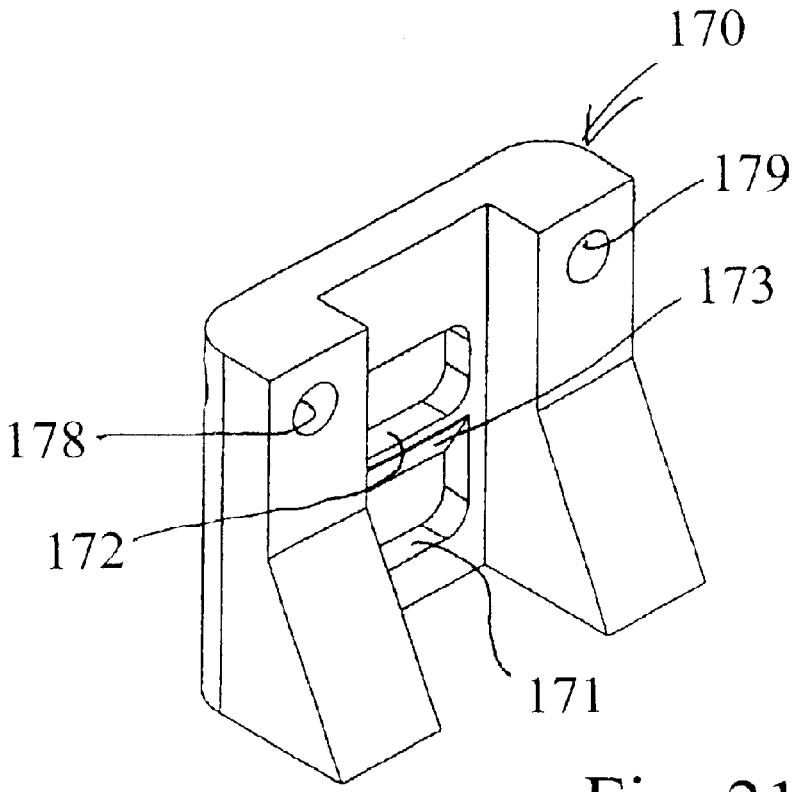
FIG. 21 is a perspective view of the bridge 170 of the present invention.
Figure 22:
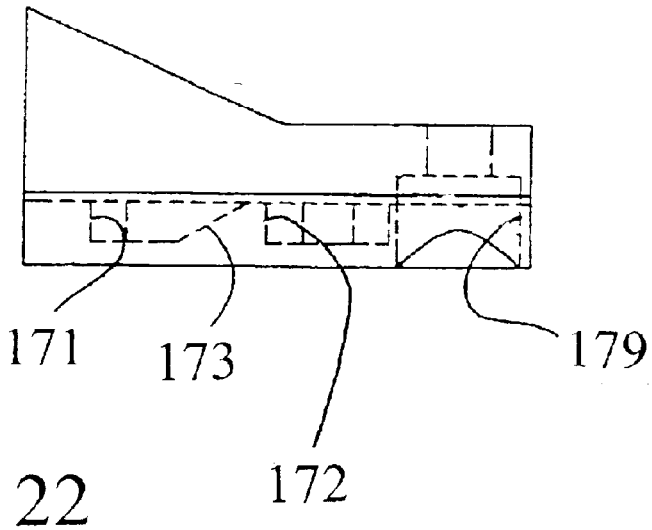
FIG. 22 is a side elevational view of the bridge showing the abutments, incline and mounting passageways in phantom.

FIGS. 21 and 22 illustrate locking bridge 170. FIG. 21 is a perspective view showing abutment 171,172 and inclined surface 173, which are the significant three surfaces with which movable locking pin 180 interacts. Bridge 170 is mounted on top of guide rails 131 and 132 and is affixed rigidly to guide rails 131 and 132 by screws 134 and 136 (FIG. 10) which extend through passageways 178 and 179 formed near the top of plate 170. FIG. 22 is a side elevational view of bridge 170 showing inclined surface 173, as well as abutments 171 and 172.

It is significant to note that, when the locking mechanism 100 of the present invention is attached to handgun 10, virtually all of mechanism 100 is contained within the handle grips. The handle grips are not shown in the drawings for clarity. Handle grips of used handguns may need minor modification to their interior molded surfaces to cover the locking mechanism 100. With these slightly modified handle grips, the only protrusion caused by locking mechanism 100 is the lower tip 152 of locking bar 150. This tip is designed to protrude below the base 17 of the handle frame 16 to allow a user to simply push upwardly on tip 152 to lock the weapon quickly without a key.

The locking mechanism 100 can be quickly and easily retrofitted onto used handguns. As shown best in FIG. 10, the only modification to the used handgun necessary for retrofitting is forming four threaded holes in the back 15 of handle frame 16 to anchor screws 133–136.

It is also significant to note that if an unauthorized person removes the lock cylinder 161 (FIG. 3), the handgun 10 will become useless and incapable of firing. The locking cylinder 161 forms the base for the main hammer spring. The main hammer spring (not shown for clarity) is carried in the hollow recess 158 of locking bar 150 (FIG. 16). Removal of locking cylinder 161 from recess 157 (FIG. 16) allows the main hammer spring to expand into recess 157 of to simply fall out of recess 157. Without the main hammer spring being properly positioned in recess 158 and compressed by lock cylinder 161, the handgun 10 cannot be fired. Only a skilled gunsmith or locksmith would be able to remove lock cylinder 161 and insert another cylinder in its place to properly compress the main hammer spring.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A locking mechanism for a semi-automatic handgun wherein said handgun has a handle frame and utilizes a drawbar in the firing mechanism which moves forwardly from a resting, non-firing position to a firing position in response to the trigger being pulled, comprising:

a movable locking bar mounted on the back of said handle frame, said locking bar being movable between a first, unlocked position in which said locking bar is below said drawbar and in which said handgun may be fired and a second, locked position in which said locking bar moves upwardly and blocks the forward motion of said drawbar so that said handgun may not be fired, and in said second position said locking bar prevents said drawbar from moving forwardly to its firing position, means for mounting said locking bar to the back of said handle frame, and a locking means for controlling the position of said locking bar, said locking means connected to said locking bar so that said locking bar in its second, locked position can be moved to its first, unlocked position only by actuating said locking means.

2. The apparatus of claim 1 wherein said locking bar includes a lower end that protrudes below said handle frame, and wherein said locking bar may be moved from its unlocked to its locked position by simply pushing upwardly on said lower end of said locking bar.

3. The apparatus of claim 2 wherein said locking means includes a key actuated cylinder mounted in the lower end of said locking bar, said cylinder including a keyway and a plurality of tumblers.

4. A locking mechanism for a semi-automatic handgun wherein said handgun has a handle frame and utilizes a drawbar in the firing mechanism which moves from a resting, non-firing position to a firing position in response to the trigger being pulled, comprising:

a movable locking bar mounted on the back of said handle frame, said locking bar being movable between a first, unlocked position in which said handgun may be fired and a second, locked position in which said handgun may not be fired, and in said second position said locking bar prevents said drawbar from moving to its firing position, means for mounting said locking bar to the back of said handle frame, a locking means for controlling the position of said locking bar, said locking means connected to said locking bar so that said locking bar in its second, locked position can be moved to its first, unlocked position only by actuating said locking means, wherein said locking bar includes a lower end that protrudes below said handle frame, and wherein said locking bar may be moved from its unlocked to its locked position by simply pushing upwardly on said lower end of said locking bar, wherein said locking means includes a key actuated cylinder mounted in the lower end of said locking bar, said cylinder including a keyway and a plurality of tumblers, a fixed bridge mounted adjacent said locking bar, said bridge including first and second abutments, a spring loaded locking pin carried by said locking bar, said locking pin engaging said first abutment when said locking bar is in its first, unlocked position, and said locking pin engaging said second abutment when said locking bar is in its second, locked position.

5. The apparatus of claim 4 wherein as said locking means is unlocked by inserting a key into the keyway of said cylinder and turning said key, said locking pin is disengaged from said second abutment and moves to said first abutment wherein said handgun is unlocked and ready to fire.

6. The apparatus of claim 5 wherein said fixed bridge further comprises an inclined surface between said first and second abutments, and as said locking bar is moved from its unlocked to its locked position, said spring loaded locking pin slides on said inclined surface and as said locking pin reaches the end of said inclined surface it engages said second abutment and said handgun is locked and cannot be fired.

* * * * *